US007032792B2

(12) United States Patent
Berry

(10) Patent No.: US 7,032,792 B2
(45) Date of Patent: Apr. 25, 2006

(54) CABLE TIE CONVENIENCE CONTAINER

(76) Inventor: Bruce Berry, 119 Waring Dr., Downingtown, PA (US) 19335

( * ) Notice: Subject to any disclaimer, the term of this patent is extended or adjusted under 35 U.S.C. 154(b) by 231 days.

(21) Appl. No.: 10/627,009

(22) Filed: Jul. 25, 2003

(65) Prior Publication Data

US 2004/0016784 A1 Jan. 29, 2004

Related U.S. Application Data

(60) Provisional application No. 60/399,179, filed on Jul. 29, 2002.

(51) Int. Cl.
*A45F 4/00* (2006.01)

(52) U.S. Cl. ..... 224/584; 383/66; 206/37

(58) Field of Classification Search ..... 224/584, 224/661, 680–684, 267, 673, 236; 383/66, 383/38, 41, 86; 206/37, 38, 236, 210, 361, 206/338

See application file for complete search history.

(56) References Cited

U.S. PATENT DOCUMENTS

| | | | | | |
|---|---|---|---|---|---|
| 1,431,352 | A | * | 10/1922 | Abbott | 206/389 |
| 2,881,947 | A | * | 4/1959 | Hancock | 221/34 |
| 3,964,606 | A | * | 6/1976 | Hogg et al. | 206/395 |
| 4,006,854 | A | * | 2/1977 | Gibson et al. | 206/409 |
| 4,119,249 | A | * | 10/1978 | Hanson | 224/236 |
| 4,252,258 | A | * | 2/1981 | Plummer, III | 225/25 |
| 4,650,073 | A | * | 3/1987 | Young | 206/409 |
| 4,850,486 | A | * | 7/1989 | Neibaur | 206/390 |
| 5,547,115 | A | * | 8/1996 | Ambrosius et al. | 224/240 |
| 5,704,479 | A | * | 1/1998 | Barnett et al. | 206/395 |
| D447,864 | S | * | 9/2001 | Casparian | D3/218 |

FOREIGN PATENT DOCUMENTS

| | | | | |
|---|---|---|---|---|
| FR | 2824050 | * | 4/2001 | 224/236 |

* cited by examiner

*Primary Examiner*—Lien M. Ngo
(74) *Attorney, Agent, or Firm*—Steve Mendelsohn

(57) ABSTRACT

A convenience container (e.g., bag, tote, or case), mounted on a person (e.g., via a belt or belt loop), work bench, or work area, simplifies access and organization of tie wraps or cable ties in the work environment. The can be made of a heavy canvas cloth and includes a cut-out in the front that allows a user to reach in with his/her fingers, grasp a tie in the tote, and pull it out for use while preventing the other ties from spilling out at the same time. An access flap at the top, bottom, or side (optionally closed with Velcro, snap, or zipper) allows loading and unloading of ties into and from the tote. A belt loop on the back allows easy attachment to a utility or regular belt on the side, back, or front of one's person. Alternatively, a belt is included with the tote. Optionally, for larger versions of the tote, an additional (removable) thigh strap is included which allows the tote to be more securely fastened to the leg and prevents it from swinging free. Other optional features include an eyelet at the top that supports ease of mounting to a workbench or work environment, use of a translucent material such that the contents can be easily determined, and, in multiple pocket configurations, color and/or tactile coding of the pockets for ease of differentiation of the pocket contents.

30 Claims, 5 Drawing Sheets

CABLE TIE CONVENIENCE CONTAINER

CROSS-REFERENCE TO RELATED APPLICATIONS

This application claims the benefit of the filing date of U.S. provisional application No. 60/399,179, filed on Jul. 29, 2002.

BACKGROUND OF THE INVENTION

1. Field of the Invention

The present invention relates to containers used for improving work efficiency.

2. Description of the Related Art

"Cable ties" or "tie wraps" (ties) (also wire or string ties and tag ties, including beaded, notched, Velcro, and ladder variants, as well as "secure" ties and "locking" ties) are widely used by a variety of tradesmen for binding together bundles of electrical wires, HVAC components, computer cables, and just about anything that needs to be joined or held together. Ties come in multiple colors, shapes, sizes, strengths, and materials. In many cases, around the country, police departments use large tie wraps in place of handcuffs.

Tradesmen, who use tie wraps as part of their regular work routine, have few convenient methods for storing and accessing ties while on the job. Cable ties or tie wraps are typically packaged in plastic bags or large boxes. Once the bag or box is opened, its contents may easily spill. Loose ties end up scattered around the bottom of toolboxes, truck beds, and work sites. When ties are needed, rather than having them close at hand, the tradesman is forced to stop work and scrounge around the bottom of a tool box or through worksite debris to find them. Any professional finds such interruptions to be an annoyance at best, and a money-wasting delay at worst. It is a common complaint among tradesmen who use tie wraps on a regular basis that they drop or lose track of these ties and have to retrieve them at inopportune times. Additionally, because tie wraps come in so many different varieties, it is common to mix different types and difficult to keep them separated as needed.

The largest professional users of tie wraps are electricians, HVAC mechanics, cable installers, computer network installers, and police departments. According to the U.S. Bureau of Labor Statistics, in 1999, there were approximately 550,000 electricians employed in the construction industry, 250,000 HVAC mechanics and installers working for heating and cooling contractors, 275,000 assorted computer and telecommunications mechanics and installers, and close to 600,000 local police officers.

Certainly not all of these individuals use tie wraps on a daily basis; however, it is reasonable to speculate that the potential number of serious users in the United States could be as high as 250,000 to 500,000 individuals—or approximately 20% to 40% of the total number of tradesmen in the target occupations. These figures do not include homeowners and "do it yourselfers" who frequent home improvement stores such as Home Depot and Hechingers.

SUMMARY OF THE INVENTION

The "tie wrap tote" is a convenience container (e.g., bag, tote, or case), mountable on a person (e.g., via a belt or belt loop, or via a strap wrapped or slung around a person's leg, arm, trunk, or neck), work bench, or work area (e.g., mounted on a hook on a telephone pole or the side of a vehicle or hanging from a ceiling support or cross beam in a structure under construction), that simplifies access and organization of tie wraps or cable ties in the work environment.

One embodiment of the tote has of a heavy canvas cloth case, which keeps the ties neatly in one place and readily available. A cut-out (e.g., a diamond-, rectangular-, circular-, or oval-shaped opening) in the front of the tote allows the user to reach in with his/her fingers, grasp a tie in the tote, and pull it out for use while preventing the other ties from spilling out at the same time. An access flap at the top, bottom, or side (optionally closed with Velcro, snap, zipper, or similar arrangement) allows loading and unloading of ties into and from the tote. A belt loop on the back allows easy attachment to a utility or regular belt on the side, back, or front of one's person. Alternatively, a belt is included with the tote. Optionally, for larger versions of the tote, an additional (removable) thigh strap is included which allows the tote to be more securely fastened to the leg and prevents it from swinging free.

One embodiment of the tote includes an eyelet at the top that supports ease of mounting to a workbench or work environment.

Another embodiment of the tote utilizes a translucent material such that the contents can be easily determined. Since multiple colors and types of tie wraps can be used, and since tie wraps are sometimes color coded and thus differentiable by virtue of their color, the translucent material helps a person organize and quickly access the desired tote from a group of totes. Another embodiment of the tote includes a dual side-by-side container construction, dual cut-outs (e.g., diamond, oval, or square) for easy access to two different types or colors of tie wraps. Another embodiment includes three or more pockets or compartments, potentially of different sizes, each of which accommodates ties of a corresponding size.

Another embodiment incorporates compartments of different colors (in the case of opaque compartment materials) or different tints (in the case of translucent compartment materials) wherein the colors or tints correspond to different types of tie wraps (that are optionally differentiated by color) that are intended to be retained in those compartments. Such a color coding of the compartments is useful as a handy reminder or guide as to which tie wraps go in which compartment of the tote during the process of refilling the tote.

Another embodiment includes multiple compartments with tactilely differentiated textures arranged side-by-side, top-and-bottom, and/or separated by a 45-degree diagonal. The tactile differences of the compartment's surfaces support use of the tote by visually impaired persons and/or provide for quicker, more convenient, non-visually assisted access to the tie wraps in a lighted, non-lighted, or poorly lit environment.

In another embodiment, the invention is a container for tie wraps that includes at least front and rear rectangular surfaces. The front and rear rectangular surfaces are coupled along three of their four edges to form at least one pocket with a top opening along the fourth edge. The front surface includes an opening for accessing tie wraps that are carried in the pocket, and the rear surface is coupled to an attachment arrangement that enables the container to be secured to another object.

In another embodiment, the invention is a container for tie wraps, which includes at least front and rear rectangular surfaces, where the front and rear rectangular surfaces are coupled along three of their four edges to form at least one pocket with a top opening along the fourth edge, the front surface includes an opening for accessing tie wraps that are carried in the pocket, and the rear surface is coupled to an attachment arrangement that enables the container to be secured to another object. The opening in the front surface is diamond shaped and has a size and position that enable a tie wrap to be removed from the pocket by a person reaching into the pocket through the opening with a thumb and finger, grabbing the tie wrap along its length, and pulling the tie wrap through the opening in a folded configuration. A first of the rectangular surfaces is longer than the other of the rectangular surfaces such that the first surface extends beyond the top edge of the other surface to form a flap that can be folded over the top opening of the pocket to form a top to the pocket, and the container further comprises a mechanism for securing the flap to the other surface wherein the mechanism comprises pieces of Velcro material correspondingly mounted to the flap and to the other surface. The tote further includes an eyelet mounted near the top edge of the container for securing the container to a work area, a ring coupled to the rear surface that enables the container to hang from a protrusion in a work area, and a loop coupled to the rear surface that enables the container to be secured to a person's belt. The front and rear surfaces are coupled using stitches; and the edges of the opening are stitched, and optionally include additional material to provide additional reinforcement.

In another embodiment, the invention is a tie-wrap container that includes a supporting structure adapted to support one or more compartments, each compartment adapted to hold tie wraps, where each compartment includes at least one access opening on a front surface of the compartment. The access opening for each compartment is smaller than the front surface of the compartment, each compartment has at least one additional opening in addition to the access opening, the additional opening being large enough to support loading and unloading of tie wraps into and from the compartment, each compartment includes a mechanism for closing the additional opening in the compartment to prevent the tie wraps from falling out, and the container is coupled to a mounting arrangement that is configured for mounting the container on a surface or to a person's body.

In another embodiment, the invention is a method for storing and accessing tie wraps. The method involves storing a plurality of tie wraps in a container comprising at least front and rear rectangular surfaces, wherein, the front and rear rectangular surfaces are coupled along three of their four edges to form at least one pocket with a top opening along the fourth edge, the front surface includes an opening for accessing tie wraps that are carried in the pocket, and the rear surface is coupled to an attachment arrangement that enables the container to be secured to another object. Additionally, the method involves removing a tie wrap from the pocket by reaching into the pocket through the opening with a thumb and finger, grabbing the tie wrap along its length, and pulling the tie wrap through the opening in a folded orientation.

In another embodiment, the invention is a method for storing and accessing tie wraps. The method involves (a) storing a plurality of tie wraps in a container comprising at least front and rear rectangular surfaces, wherein the front and rear rectangular surfaces are coupled along three of their four edges to form at least one pocket with a top opening along the fourth edge, the front surface includes an opening for accessing tie wraps that are carried in the pocket, and the rear surface is coupled to an attachment arrangement that enables the container to be secured to another object. The method further involves (b) removing a tie wrap from the pocket by reaching into the pocket through the opening with a thumb and finger, grabbing the tie wrap along its length, and pulling the tie wrap through the opening in a folded orientation, (c) securing the container to a person's belt by passing the belt through a belt loop of the container, (d) optionally securing the container to the person's thigh by strapping the container to the person's thigh using a strap of the container, (e) opening a flap at the top of the container to expose the top opening of the pocket, and (f) inserting additional tie wraps into the pocket through the top opening. In this method, the container includes a plurality of pockets and the method further involves differentiating the plurality of pockets based on each pocket being made from material having a different color and differentiating the plurality of pockets based on each pocket being made from tactilely differentiated material.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments.

Tie wraps of various sorts are widely used in many different industries. Keeping these tie wraps organized and easily accessible on the job is a recognized problem, which, prior to the present invention, did not have a good solution.

The tie wrap tote of the present invention is a utilitarian product for a working environment and provides a convenient and efficient solution to the storage, carriage, and access of tie wraps on the job. The tie wrap tote solves an annoying problem for cable, telecommunications, and related trades groups.

Figure 1:
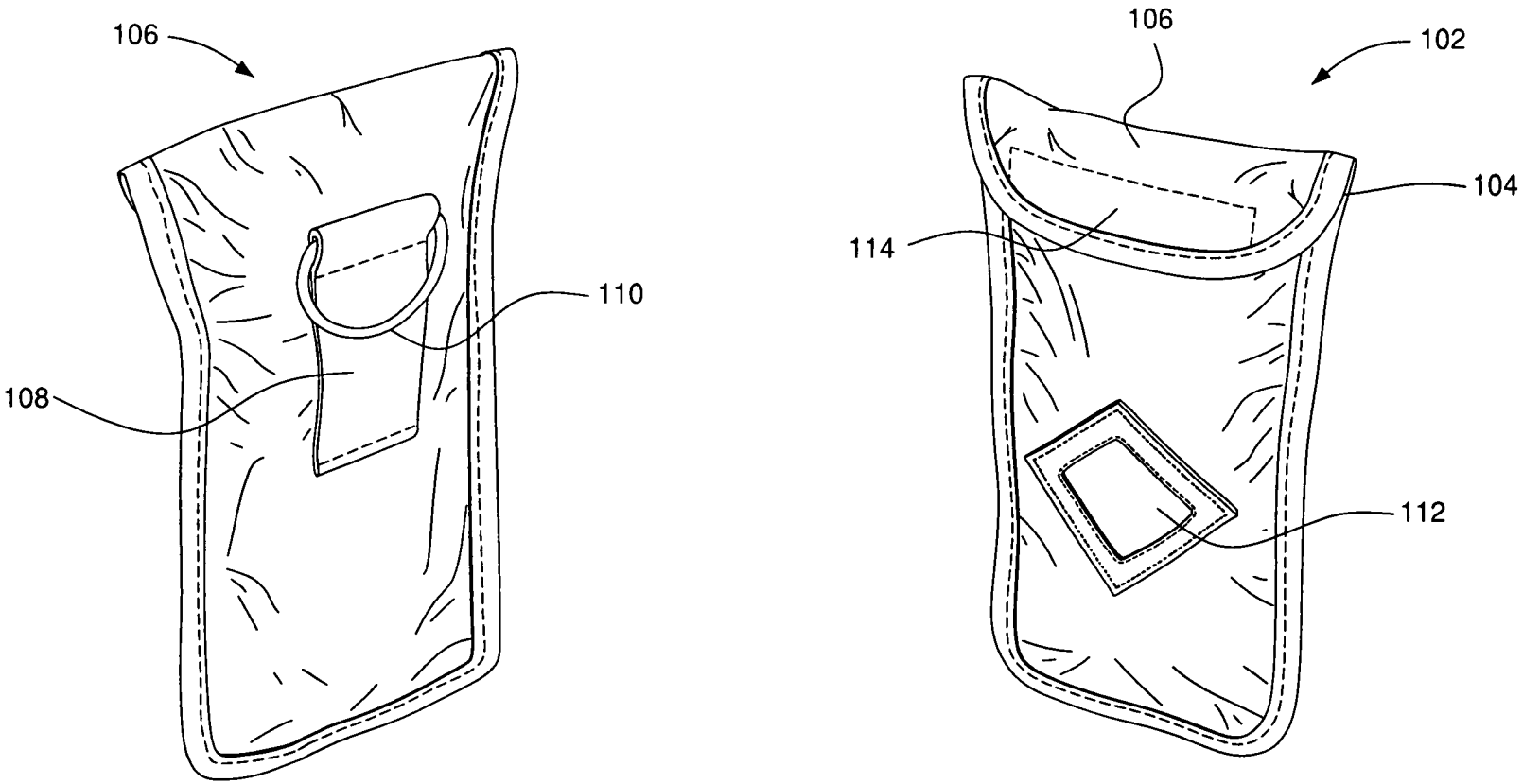
FIGS. 1(*a*) and (*b*) illustrate front and back perspective views, respectively, of one embodiment of the tie wrap tote of this invention.

FIGS. 1(*a*) and (*b*) illustrate front and back perspective views, respectively, of one embodiment of the tie wrap tote of this invention. The tie wrap tote includes a sack, pocket, or container 102, with a top opening 104 covered by a closure flap 106 which allows loading and unloading of tie wraps into and from sack 102. Belt loop 108 is included, which provides for attachment to a belt, as well as ring 110, which supports hanging the tote on a work area nail or hook, or suspending the tote from a utility belt. Optionally a thigh strap (not illustrated) can be used to attach the tote more securely by providing an attachment strap for use around the thigh. FIG. 1 also shows access opening 112 in a diamond shape (one of the more ergonomic and easy to manufacture options for the access opening), which allows a worker to access tie wraps on the job by reaching into opening 112 with (typically) thumb and pointer or middle fingers. The access opening in the front surface has a size, shape, and position that enable a tie wrap to be removed from the pocket by a person reaching into the pocket through the opening with a thumb and finger, grabbing the tie wrap along its length, pulling the tie wrap through the opening and in so doing, deforming the tie wrap from its normally linear configuration into a folded configuration, and removing the tie wrap from the pocket in a folded configuration. Note that opening 112 is reinforced and double stitched to provide added robustness to the opening of the tote, which is anticipated to receive heavy use. FIG. 1 also illustrates closure mechanism 114 on closure flap 106 at the top of the tote. This closure mechanism uses Velcro material or other means (e.g., a snap or zipper) to secure the top and keep tie wraps within the tote.

Figure 2A:
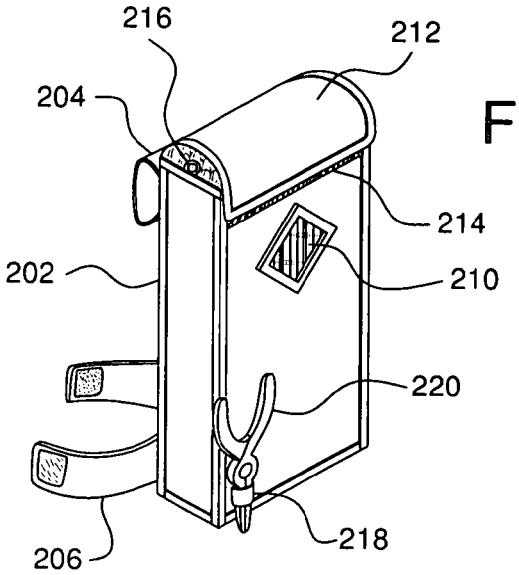
FIGS. 2(*a*) and (*b*) illustrate a tie wrap tote and its mounting on a person, respectively.
Figure 2B:
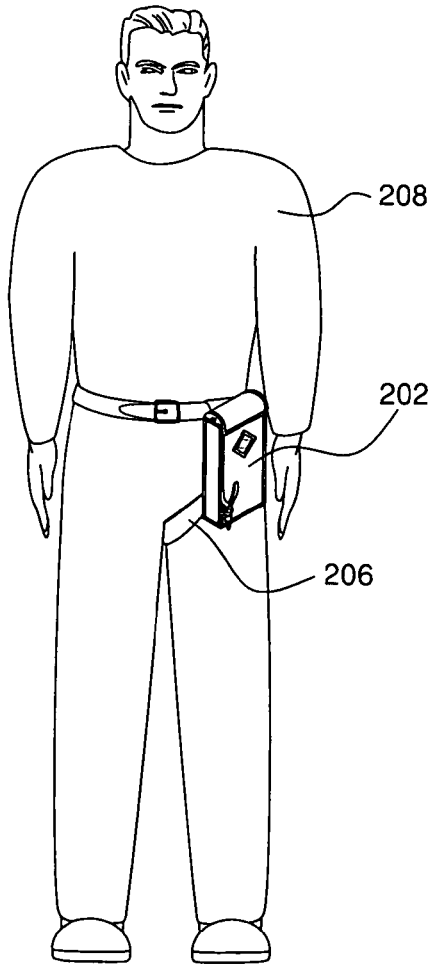

FIGS. 2(*a*) and (*b*) illustrate a tie wrap tote and its mounting on a person, respectively. It shows how tie-wrap tote 202 is mounted via belt loop 204 and optional thigh strap 206 to workman 208. It also shows access opening 210 in a diamond shape, which allows a worker to access tie wraps on the job by reaching into access opening 210 with his/her (typically) thumb and pointer or middle fingers. FIG. 2 also illustrates closure flap 212 at the top of the tote, which is closed using Velcro material 214 (or alternative means, e.g., snap or zipper) and which allows loading and unloading of tie wraps into and from the tote. Eyelet 216 is also illustrated. Some embodiments include this eyelet to allow easy mounting to a convenient work surface when the tote is not mounted on a person. For example, this eyelet might be used for hanging the tote near an electrical panel or a computer network hub, to keep tie wraps accessible, while working for long periods of time, potentially in a mechanical room or electrical closet. Some embodiments include an optional cutter loop 218 for convenient storage of a clipper or wire/plastic cutter (e.g., cutter 220) that may be employed to snip the excess material from a tie after it has been used to wrap a cable.

The challenge of containing longer tie wraps, those ranging from about 13" to about 22", can be met by folding these ties in half, thereby allowing a reasonable size tote (e.g., relative to leg length) to hold ties up to at least 22".

Figure 3:
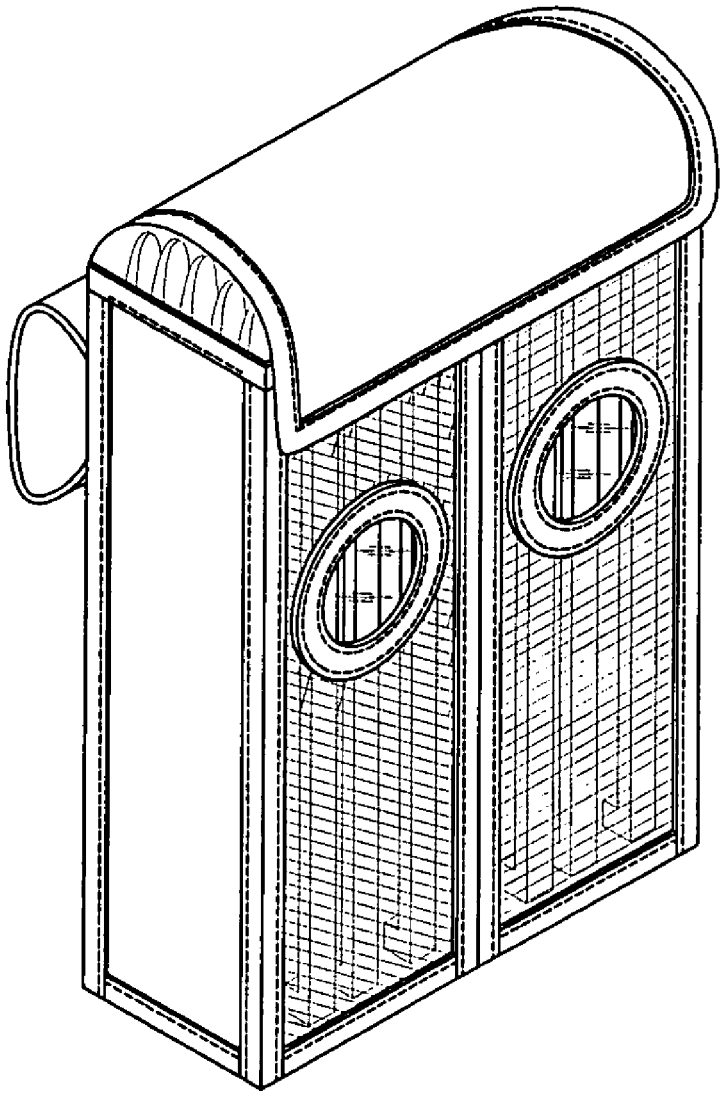
FIG. 3 illustrates a dual side-by-side tote embodiment.

FIG. 3 illustrates a dual side-by-side tote embodiment. Here, two different types of tie wrap can be stored, organized, and easily accessed. Optionally, translucent and potentially style-tinted material and/or tactilely differentiated surfaces, access hole locations, or raised identifiers (e.g., Braille or iconic symbols) can be used to help quickly differentiate the two side-by-side pockets.

Figure 4:
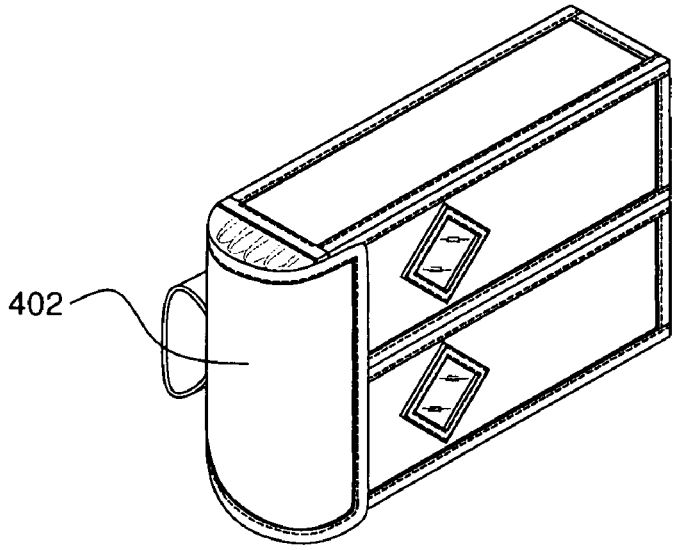
FIG. 4 illustrates a top-and-bottom tote embodiment.

FIG. 4 illustrates a top-and-bottom tote embodiment. Here, the pockets are top-and-bottom differentiated and the access flap (402) is along one side.

Figure 5:
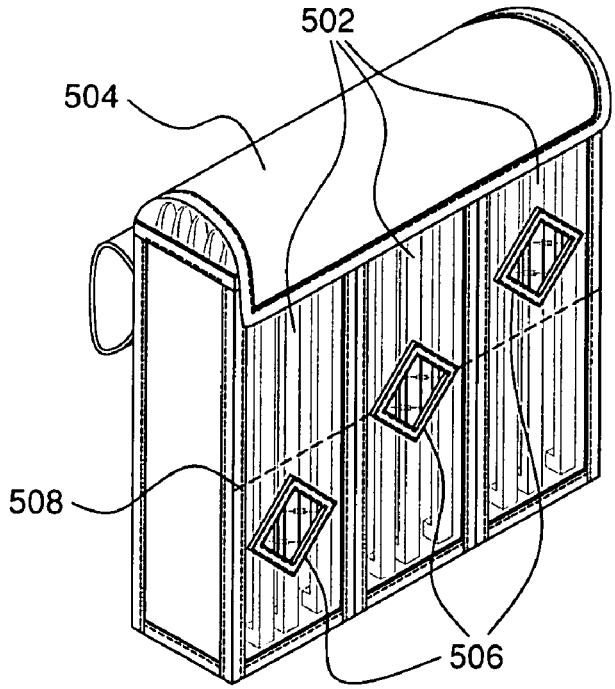
FIG. 5 illustrates a triple side-by-side translucent tote embodiment.

FIG. 5 illustrates a triple side-by-side (optionally translucent material and/or tactilely differentiated surface) tote embodiment with three subcontainers or pockets (502) with loading and unloading opening at the top (504) and cutout (506) for tie access in the middle of each pocket or staggered in position about the vertical midpoint (508) for additional tactile differentiation.

The fabric and stitching of the tote should be durable and heavy duty; however, there is no requirement for exceptional precision in the dimensions. Thus, the tie wrap tote is easy and inexpensive to manufacture.

Most tradesmen wear tool belts of one sort or another, for the express purpose of keeping commonly used tools close at hand. The tie wrap tote can be designed to be attached to and worn on many types of belts including a tool belt.

Construction

The tie wrap tote can be manufactured from a variety of materials including vinyl, nylon, polyester, polypropylene, laminated fabrics, cotton duck, leather (including synthetic or imitation leathers), canvas, plastic, or any fabric that can be sewn, bound, or formed in any way into a pouch or tote to hold or contain wire ties or tie wraps.

The material of the tote need not be a continuous material. In other words, a mesh or horizontal rib structure could be sufficient for construction as long as the task of containing the ties and providing the benefits of the invention are retained.

The tie wrap tote flap or closure can be accomplished using one or more of Velcro material, latch and hook, snaps, zipper, buckle, buttons or combinations of the aforementioned or equivalents.

The tote may be constructed by various methods. For example, in one implementation the tote is constructed from a single piece of material folded at the bottom edge and stitched along the two sides to form a pocket. In this implementation, the material is folded in such a way that the back side is longer than the front side and the additional material is formed into a flap that can be used to cover the top opening in the pocket. Alternatively, the single piece of material could be folded along one side and stitched along the bottom and other side (although this might make the flap more difficult to manufacture). Additionally, additional material or folds or creases in a single material may be used in smooth or accordion fashion to provide additional depth or width to the tote allowing it to accommodate a larger capacity of tie wraps. Also, in one or more embodiments, the material or portions thereof may be flexible and able to stretch to accommodate additional tie wraps in the tote.

The tie wrap tote can be made in various sizes to accommodate the many different sizes of tie wraps. As illustrated by the exemplary embodiment of FIG. 6(*a*), one design for the present invention provides an adjustable-length tote by making the bottom of the tote out of a sleeve that slides over the upper portion and can be secured (e.g., via snaps or Velcro material) at one of a number of different positions from the top, corresponding to popular tie wrap sizes. As shown, the length of tote 602 is adjusted by sliding the bottom sleeve 604 up or down the lower portion of the tote. In this example, the front view of the tote is shown. To secure the length of the tote at a particular length, female snap connector 606 is snapped to male snap connector 608 or 610. A similar snap arrangement is used on the back side of the tote or alternatively on the sides of the tote. Note that the top closure detail is not illustrated in FIG. 6(*a*).

Note that the tote may have its loading opening (and associated length adjustment mechanism) at either the bottom or top.

Figure 6A:
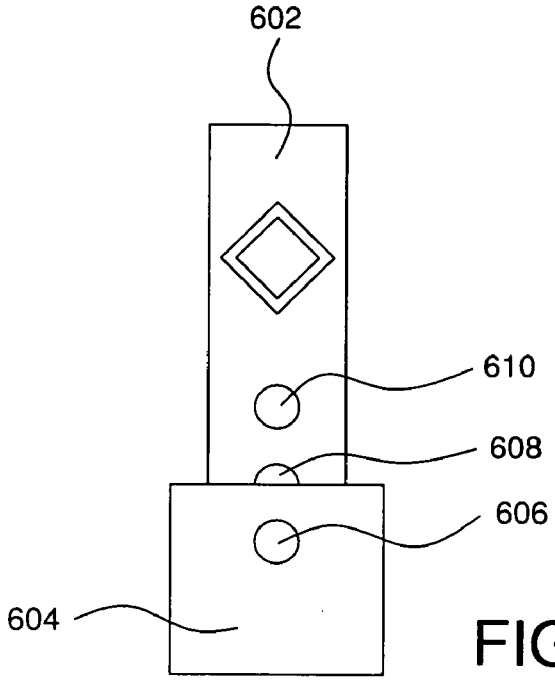
FIGS. 6(*a*) and (*b*) illustrate two embodiments of adjustable-length tie-wrap totes.
Figure 6B:
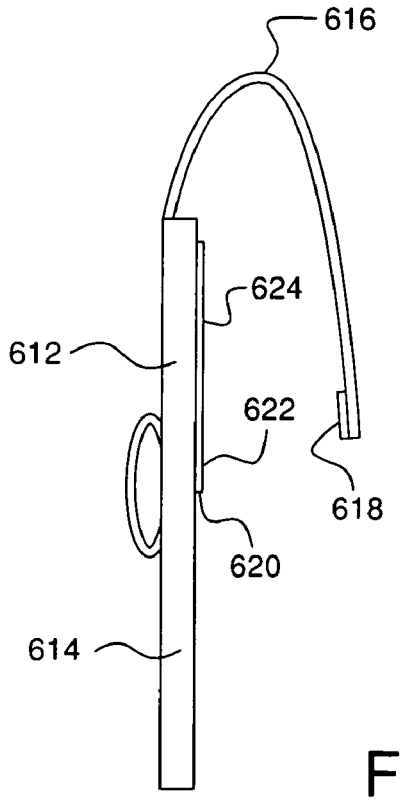

Another embodiment of an adjustable-size tote according to the present invention provides for the bottom portion of one surface of the tote to be folded upward partially and secured (e.g., via snap or Velcro material) effectively creating a shortened-length bag. An alternative embodiment provides for adjusting the length of the tote by providing options for where the top flap attaches to the front surface of the tote as illustrated by FIG. 6(*b*). As shown in FIG. 6(*b*), surface 612 of tote 614 is extended (616) over the opening in the top of the tote and can be optionally attached via Velcro (hook) pad 618 to Velcro (eye) receiving pad 620 at a variety of different positions (622 or 624) to adjust the size of the tote and thereby the tie wraps that it can accommodate.

Some exemplary dimensions follow, but it should be understood to one skilled in the art that totes according to the present invention can be made in a variety of sizes and may have some adjustability to accommodate the wide diversity of tie wraps available.

For example, a nominally dimensioned tote which will handle 100 tie wraps in sizes 7" through 9", might be approximately 5.75" wide×10.5" long. As another example, a nominally dimensioned tote which will handle 100 tie wraps in sizes 9" through 12", might be approximately 5.75" wide×13.25" long.

In one implementation, the opening on the front of a tote with a diamond cutout has an inner dimension (or diameter for a circular opening) of 1.375" and outer dimension of 2.375" and the opening is reinforced with heavy vinyl which measures 0.4375" wide×0.0625" thick and is double stitched to the tote for toughness.

While this invention has been described with reference to illustrative embodiments, this description should not be construed in a limiting sense. Various modifications of the described embodiments, as well as other embodiments of the invention, which are apparent to persons skilled in the art to which the invention pertains are deemed to lie within the principle and scope of the invention as expressed in the following claims.

What is claimed is:

1. A container for tie wraps, comprising at least front and rear rectangular surfaces, wherein:

the front and rear rectangular surfaces are coupled along three of their four edges to form at least one pocket with a top opening along the fourth edge;

the front surface includes a diamond-shaped opening having four corners, wherein the diamond-shaped opening is positioned near the center of the front surface and oriented such that a first line defined by a first pair of opposing corners of the diamond-shaped opening is substantially parallel to top and bottom edges of the front and rear surfaces, the diamond-shaped opening being adapted for accessing tie wraps that are carried in the pocket;

the rear surface is coupled to an attachment arrangement that enables the container to be secured to another object; and the diamond-shaped opening in the front surface has a size, shape, orientation, and position that enable a tie wrap oriented substantially perpendicular to the first line to be efficiently removed from the pocket by a person reaching into the pocket through the diamond-shaped opening with a thumb and finger oriented corresponding to the first pair of opposing corners of the diamond-shaped opening, grabbing the tie wrap along its length, and pulling the tie wrap through the diamond-shaped opening such that the tie wrap deforms from its normally linear configuration into a folded configuration oriented corresponding to the other pair of opposing corners of the diamond-shaped opening, such that other tie wraps remain within the pocket.

2. The invention of claim 1, wherein:

the rear rectangular surface is longer than the front rectangular surface such that the rear surface extends beyond the top edge of the front surface to form a flap that can be folded over the top opening of the pocket to form a top to the pocket; and the container further comprises a mechanism for securing the flap to the front surface.

3. The invention of claim 2, wherein the mechanism comprises pieces of a hook-and-loop material correspondingly mounted to the flap and to the front surface.

4. The invention of claim 1, further comprising an eyelet mounted near the top edge of the container for securing the container to a work area.

5. The invention of claim 1, further comprising a ring coupled to the rear surface and enabling the container to hang from a protrusion in a work area.

6. The invention of claim 1, further comprising a loop coupled to the rear surface and enabling the container to be secured to a person's belt.

7. The invention of claim 1, wherein the front and rear surfaces are coupled together using additional material to add depth to the container.

8. The invention of claim 1, wherein the front and rear surfaces comprise a flexible material that can stretch to accommodate tie wraps.

9. The invention of claim 1, wherein the front and rear surfaces are coupled using stitches.

10. The invention of claim 1, wherein edges of the diamond-shape opening are stitched to provide additional reinforcement.

11. The invention of claim 1, wherein the edges of the diamond-shape opening are reinforced with additional material.

12. The invention of claim 1, further comprising a strap coupled to the rear surface and enabling the container to be secured to a person's thigh.

13. The invention of claim 1, wherein at least one of the front and rear surfaces is made from a translucent material.

14. The invention of claim 1, wherein at least one of the front and rear surfaces is color coded.

15. The invention of claim 1, wherein the container comprises two or more pockets.

16. The invention of claim 15, wherein the front surface of the two or more pockets have different colors.

17. The invention of claim 15, wherein the front surface of the two or more pockets are tactilely differentiated from each other.

18. The invention of claim 1, wherein the front and rear surfaces are made from a single piece of material folded along one side and stitched along two other sides.

19. A container for tie wraps, comprising at least front and rear rectangular surfaces, wherein:

the front and rear rectangular surfaces are coupled along three of their four edges to form at least one pocket with a top opening along the fourth edge;

the front surface includes a diamond-shaped opening having four corners, wherein the diamond-shaped opening is positioned near the center of the front surface and oriented such that a first line defined by a first pair of opposing corners of the diamond-shaped opening is substantially parallel to top and bottom edges of the front and rear surfaces, the diamond-shaped opening being adapted for accessing tie wraps that are carried in the pocket; and the rear surface is coupled to an attachment arrangement that enables the container to be secured to another object, wherein:

the diamond-shaped opening in the front surface has a size, shape, orientation, and position that enable a tie wrap oriented substantially perpendicular to the first line to be efficiently removed from the pocket by a person reaching into the pocket through the diamond-shaped opening with a thumb and finger oriented corresponding to the first pair of opposing corners of the diamond-shaped opening, grabbing the tie wrap along its length, and pulling the tie wrap through the diamond-shaped opening such that the tie wrap deforms from its normally linear configuration into a folded configuration oriented corresponding to the other pair of opposing corners of the diamond-shaped opening, such that other tie wraps remain within the pocket;

the rear rectangular surface is longer than the front rectangular surface such that the rear surface extends beyond the top edge of the front surface to form a flap that can be folded over the top opening of the pocket to form a top to the pocket and the container further comprises a mechanism for securing the flap to the other surface wherein the mechanism comprises pieces of a hook-and-loop material correspondingly mounted to the flap and to the front surface;

the container further comprises an eyelet mounted near the top edge of the container for securing the container to a work area;

the container further comprises a ring coupled to the rear surface that enables the container to bang from a protrusion in a work area and a loop coupled to the rear surface that enables the container to be secured to a person's belt;

the front and rear surfaces are coupled using stitches; and the edges of the diamond-shaped opening are stitched, and include additional material to provide additional reinforcement.

20. A tie-wrap container, comprising a supporting structure adapted to support one or more compartments, each compartment adapted to hold tie wraps, wherein:

each compartment includes at least one diamond-shaped access opening on a front surface of the compartment;

the diamond-shaped access opening for each compartment has four corners and is positioned near the center of the front surface of the compartment and oriented such that a first line defined by a first pair of opposing corners of the diamond-shaped access opening is substantially parallel to top and bottom edges of the compartment, the diamond-shaped access opening being adapted for accessing tie wraps that are carried in the compartment;

the diamond-shaped access opening for each compartment is smaller than the front surface of the compartment;

the diamond-shaped access opening for each compartment has a size, shape, orientation, and position that enable a tie wrap oriented substantially perpendicular to the first line to be efficiently removed from the compartment by a person reaching into the compartment through the diamond-shaped access opening with a thumb and finger oriented corresponding to the first pair of opposing corners of the diamond-shaped access opening, grabbing the tie wrap alone its length, and pulling the tie wrap through the diamond-shaped access opening such that the tie wrap deforms from its normally linear configuration into a folded configuration oriented corresponding to the other pair of opposing corners of the diamond-shaped access opening, such that other tie wraps remain within the compartment;

each compartment has at least one additional opening in addition to the diamond-shaped access opening, the additional opening being large enough to support loading and unloading of tie wraps into and from the compartment;

each compartment includes a mechanism for closing the additional opening in the compartment to prevent the tie wraps from falling out; and the container is coupled to a mounting arrangement that is configured for mounting the container on a surface or to a person's body.

21. The invention of claim 20, wherein the container includes two or more compartments, each of which is color coded differently or tactilely differentiated from the others.

22. The invention of claim 20, wherein the material of at least one of the compartments includes a translucent portion.

23. A method for storing and accessing tie wraps, comprising the steps of:

(a) storing a plurality of tie wraps in a container comprising at least front and rear rectangular surfaces, wherein:

the front and rear rectangular surfaces are coupled along three of their four edges to form at least one pocket with a top opening along the fourth edge;

the front surface includes a diamond-shaped opening having four corners, wherein the diamond-shaped opening is positioned near the center of the front surface and oriented such that a first line defined by a first pair of opposing corners of the diamond-shaped opening is substantially parallel to top and bottom edges of the front and rear surfaces, the diamond-shaped opening being adapted for accessing tie wraps that are carried in the pocket;

the rear surface is coupled to an attachment arrangement that enables the container to be secured to another object; and the diamond-shaped opening in the front surface has a size, shape, orientation, and position that enable a tie wrap oriented substantially perpendicular to the first line to be efficiently removed from the rocket by a person reaching into the pocket through the diamond-shaped opening with a thumb and finger oriented corresponding to the first pair of opposing corners of the diamond-shaped opening, grabbing the tie wrap along its length, and pulling the tie wrap through the diamond-shaped opening such that the tie wrap deforms from its normally linear configuration into a folded configuration oriented corresponding to the other pair of opposing corners of the diamond-shaped opening, such that other tie wraps remain within the pocket; and (b) removing a tie wrap from the pocket by reaching into the pocket through the diamond-shaped opening with a thumb and finger oriented corresponding to the first pair of opposing corners of the diamond-shaped opening, grabbing the tie wrap along its length, and pulling the tie wrap through the diamond-shaped opening such that the tie wrap deforms from its normally linear configuration into a folded orientation oriented corresponding to the other pair of opposing corners of the diamond-shaped opening, such that other tie wraps remain within the pocket.

24. The invention of claim 23, further comprising the step of securing the container to a person's belt by passing the belt through a belt loop of the container.

25. The invention of claim 24, further comprising the step of securing the container to the person's thigh by strapping the container to the person's thigh using a strap of the container.

26. The invention of claim 23, further comprising the steps of:

(c) opening a flap at the top of the container to expose the top opening of the pocket; and (d) inserting additional tie wraps into the pocket through the top opening.

27. The invention of claim 23, wherein the container comprises a plurality of pockets and further comprising the step of differentiating the plurality of pockets based on each pocket being made from material having a different color.

28. The invention of claim 23, wherein the container comprises a plurality of pockets and further comprising the step of differentiating the plurality of pockets based on each pocket being made from tactiley differentiated material.

29. A method for storing and accessing tie wraps, comprising the steps of:

(a) storing a plurality of tie wraps in a container comprising at least front and rear rectangular surfaces, wherein:

the front and rear rectangular surfaces are coupled along three of their four edges to form at least one pocket with a top opening along the fourth edge;

the front surface includes a diamond-shaped opening having four corners, wherein the diamond-shaped opening is positioned near the center of the front surface and oriented such that a first line defined by a first pair of opposing corners of the diamond-shaped opening is substantially parallel to top and bottom edges of the front and rear surfaces, the diamond-shaped opening being adapted for accessing tie wraps that are carried in the pocket;

the diamond-shaped opening in the front surface has a size, shape, orientation, and position that enable a tie wrap oriented substantially perpendicular to the first line to be efficiently removed from the pocket by a person reaching into the pocket through the diamond-shaped opening with a thumb and finger oriented corresponding to the first pair of opposing corners of the diamond-shaped opening, grabbing the tie wrap alone its length, and pulling the tie wrap through the diamond-shaped opening such that the tie wrap deforms from its normally linear configuration into a folded configuration oriented corresponding to the other pair of opposing corners of the diamond-shaped opening, such that other tie wraps remain within the pocket; and the rear surface is coupled to an attachment arrangement that enables the container to be secured to another object;

(b) removing a tie wrap from the pocket by reaching into the pocket through the diamond-shaped opening with a thumb and finger oriented corresponding to the first pair of opposing corners of the diamond-shaped opening, grabbing the tie wrap along its length, and pulling the tie wrap through the opening such that the tie wrap deforms from its normally linear configuration into a folded orientation oriented corresponding to the other pair of opposing corners of the diamond-shaped opening, such that other tie wraps remain within the pocket;

(c) securing the container to a person's belt by passing the belt through a belt loop of the container;

(d) opening a flap at the top of the container to expose the top opening of the pocket; and (e) inserting additional tie wraps into the pocket through the top opening wherein:

the container comprises a plurality of pockets and the method further comprises the steps of differentiating the plurality of pockets based on each pocket being made from material having a different color and differentiating the plurality of pockets based on each pocket being made from tactilely differentiated material.

30. The invention of claim 29, further comprising securing the container to the person's thigh by strapping the container to the person's thigh using a strap of the container.

* * * * *